US005907892A

United States Patent [19]

Todd

[11] Patent Number: 5,907,892

[45] Date of Patent: Jun. 1, 1999

[54] CHILD SAFETY APPARATUS FOR A SEAT BELT BUCKLE

[75] Inventor: Maureen Todd, Durham, United Kingdom

[73] Assignee: TRW Vehicle Safety Systems Inc., Lyndhurst, Ohio

[21] Appl. No.: 09/094,934

[22] Filed: Jun. 15, 1998

[51] Int. Cl.[6] ..... A44B 11/00

[52] U.S. Cl. ..... 24/642; 24/633; 24/645; 24/657

[58] Field of Search ..... 24/642, 633, 634, 24/639, 640, 657

[56] References Cited

U.S. PATENT DOCUMENTS

| | | | |
|---|---|---|---|
| 2,941,272 | 6/1960 | Bourguignon | 24/657 |
| 3,201,840 | 8/1965 | Jantzen | 24/634 |
| 4,624,033 | 11/1986 | Orton . | |
| 4,675,954 | 6/1987 | Gullickson . | |
| 4,675,956 | 6/1987 | Cohen | 24/642 |
| 4,791,711 | 12/1988 | Adams . | |
| 4,955,115 | 9/1990 | Tanaka . | |
| 5,184,376 | 2/1993 | Hunter et al. . | |
| 5,232,732 | 8/1993 | Yamanishi | 24/633 |
| 5,307,544 | 5/1994 | Quarberg et al. . | |
| 5,704,099 | 1/1998 | Cahill . | |
| 5,742,986 | 4/1998 | Corrion et al. | 24/645 |

*Primary Examiner*—Victor N. Sakran
*Attorney, Agent, or Firm*—Tarolli, Sundheim, Covell, Tummino & Szabo

[57] ABSTRACT

An apparatus (10) includes a latch mechanism (26) that releasably interlocks with a seat belt tongue (16), and further includes a safety apparatus (50) for the latch mechanism (26). The latch mechanism (26) includes a pushbutton (24) which is movable manually from a rest position to a release position. The safety apparatus (50) includes a retarder device (52) that is switchable into and out of an actuated condition in which the retarder device (52) resists movement of the pushbutton (24) during movement of the pushbutton (24) to the release position.

14 Claims, 3 Drawing Sheets

CHILD SAFETY APPARATUS FOR A SEAT BELT BUCKLE

FIELD OF THE INVENTION

The present invention relates to a seat belt buckle.

BACKGROUND OF THE INVENTION

A seat belt system for restraining a vehicle occupant typically includes seat belt webbing, a seat belt locking tongue on the webbing, and a seat belt buckle. The tongue on the webbing is inserted in the buckle when the webbing has been placed about a vehicle occupant. A latch mechanism in the buckle interlocks with the tongue to secure the webbing about the occupant. The latch mechanism includes a pushbutton for releasing the tongue from the buckle. It may be possible for a small child to depress the pushbutton to release the tongue from the buckle without the assistance of an adult.

SUMMARY OF THE INVENTION

In accordance with the present invention, an apparatus comprises a latch mechanism that releasably interlocks with a seat belt tongue, and further comprises a safety apparatus for the latch mechanism. The latch mechanism includes a pushbutton which is movable manually from a rest position to a release position. The safety apparatus comprises a retarder device that is switchable into and out of an actuated condition. When the retarder device is in the actuated condition, it resists movement of the pushbutton during movement of the pushbutton to the release position.

BRIEF DESCRIPTION OF THE DRAWINGS

The foregoing and other features of the present invention will become apparent to one skilled in the art to which the present invention relates upon reading the following description of the invention with reference to the accompanying drawings, wherein.

DESCRIPTION OF A PREFERRED EMBODIMENT

Figure 1:
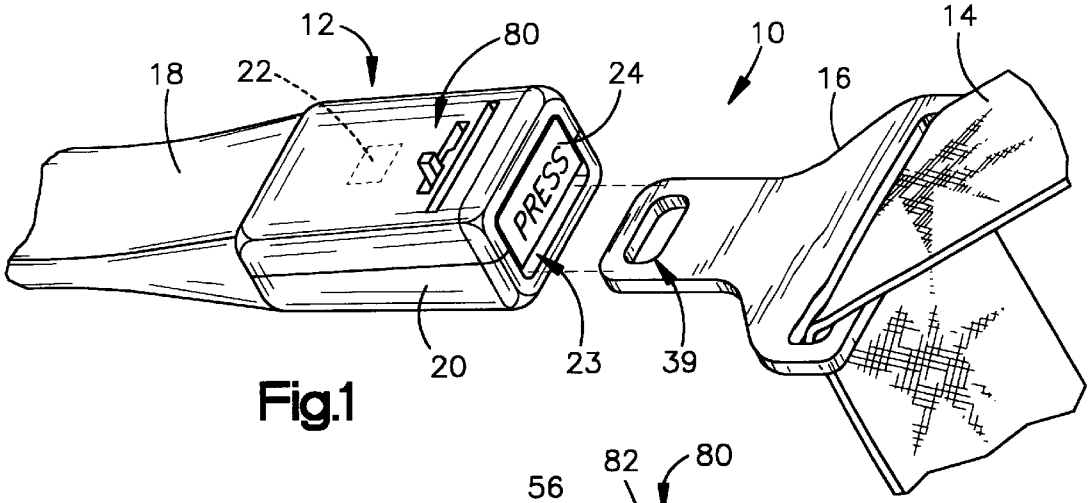
FIG. 1 is an isometric view of a vehicle occupant restraint apparatus comprising a first embodiment of the present invention.

A vehicle occupant restraint apparatus 10 comprising a preferred embodiment of the present invention is shown partially in FIG. 1. The apparatus 10 includes a seat belt buckle 12, seat belt webbing 14, and a seat belt tongue 16 on the webbing 14. The buckle 12 is anchored in a vehicle in a known manner, such as by a cable or anchor strap (not shown) extending within a cover 18.

The buckle 12 has a housing 20 containing a latch 22 (shown schematically in FIG. 1). When the tongue 16 is moved into an opening 23 at the end of the buckle 12, the latch 22 engages the tongue 16 to lock the tongue 16 in the buckle 12. The tongue 16 is subsequently released from the buckle 12 upon depression of a pushbutton 24 adjacent to the opening 23.

Figure 2:
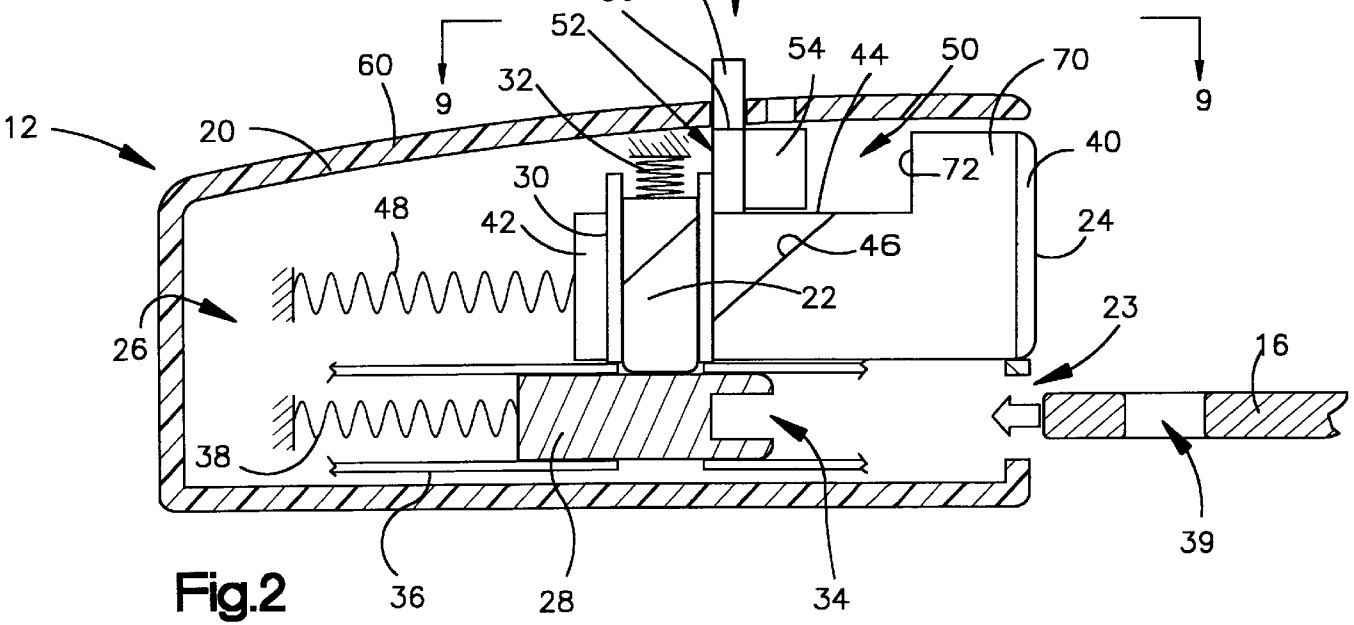
FIG. 2 is a side view, partly in section, of parts of the apparatus of FIG. 1, with certain parts being shown schematically.
Figure 3:
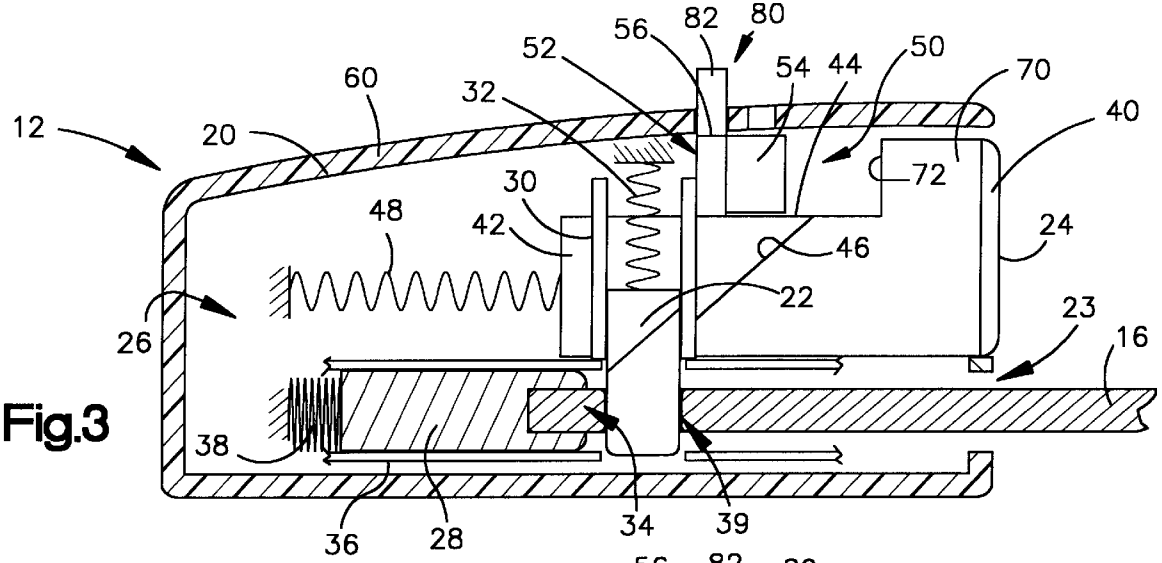
FIGS. 3 and 4 are views similar to FIG. 2 showing parts in different positions.
Figure 4:
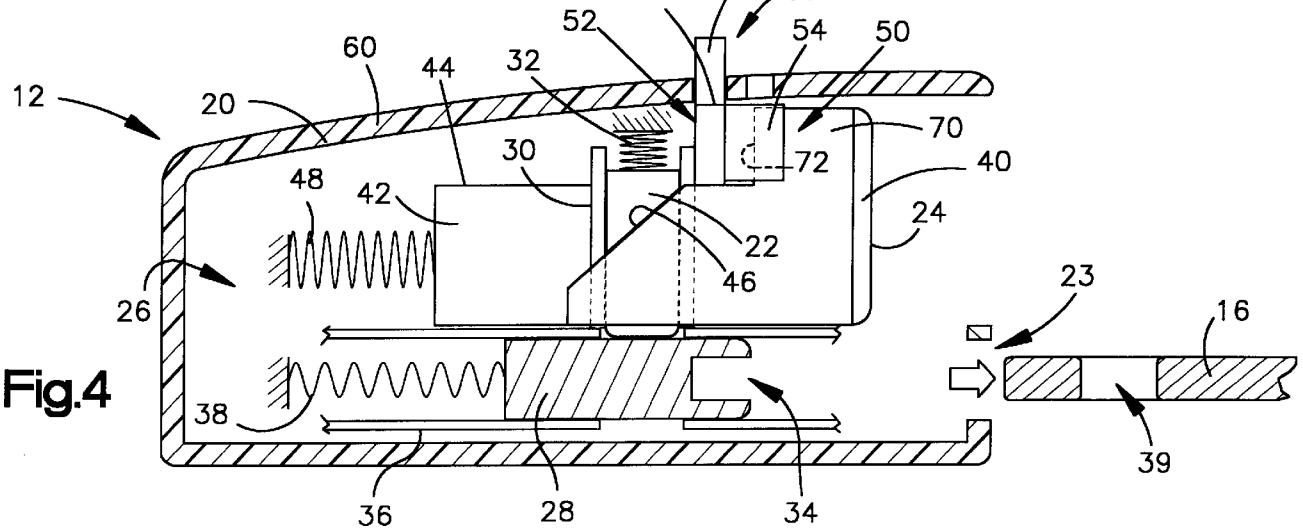

As shown schematically in FIGS. 2–4, the latch 22 and the pushbutton 24 are parts of a latch mechanism 26 that further includes an ejector 28 and a plurality of springs. The latch 22 is movable between a non-locking position (FIG. 2) and a locking position (FIG. 3). A guide structure 30 guides movement of the latch 22 between those positions. When the tongue 16 is located outside the buckle 12, as shown in FIG. 2, the ejector 28 holds the latch 22 in the non-locking position against the bias of a latch spring 32.

When the tongue 16 is inserted through the opening 23, as indicated by the arrow shown in FIG. 2, it is moved into engagement with the ejector 28 in a notch 34 at the end of the ejector 28. The tongue 16 is then moved inward against the ejector 28 so as to push the ejector 28 along a track 36 from a forward position (FIG. 2) to a rearward position (FIG. 3) against the bias of an ejector spring 38.

As the tongue 16 and the ejector 28 approach the positions of FIG. 3, an aperture 39 in the tongue 16 moves into alignment with the latch 22. The latch spring 32 then moves the latch 22 to the locking position through the aperture 39 in the tongue 16 so that the latch 22 blocks removal of the tongue 16 from the buckle 12. The tongue 16 is thus interlocked with the latch mechanism 26 upon being moved into the buckle 12 to the position of FIG. 3.

The pushbutton 24 has an outer wall 40. The pushbutton 24 further has a pair of inner walls 42 (one of which is shown in FIGS. 2–4) projecting inward from and perpendicular to the outer wall 40. The inner walls are spaced apart across the width of the buckle 12, i.e., in a direction perpendicular to the page as viewed in FIGS. 2–4. Each inner wall 42 has an upper edge surface 44 and a ramp surface 46.

When the tongue 16 is to be released from the buckle 12, the pushbutton 24 is moved from a rest position, as shown in FIGS. 2 and 3, to a release position, as shown in FIG. 4, against the bias of a pushbutton spring 48. The ramp surfaces 46 on the pushbutton 24 move against complementary ramp surfaces on the latch 22 to move the latch 22 back out of the aperture 39 in the tongue 16 against the bias of the latch spring 32. The ejector spring 38 then moves the ejector 28 back outward along the track 36 toward the opening 23 to eject the tongue 16 from the buckle 12.

The buckle 12 is equipped with a safety apparatus 50 in accordance with the present invention. The safety apparatus 50 includes a retarder device 52 which, when actuated, cooperates with the latch mechanism 26 to prevent a small child from releasing the tongue 16 from the buckle 12.

As shown in the side views of FIGS. 2–4, the retarder device 52 in the preferred embodiment of the present invention comprises a bumper 54 and a slider bar 56. As viewed from above in FIGS. 5–8, the bumper 54 is one of a pair of bumpers 54 that are spaced apart along the length of the slider bar 56. The bumpers 54 in the preferred embodiment are formed of rubber, and are fixed to the slider bar 56 by a corresponding pair of adhesive bonds 58. The slider bar 56 in the preferred embodiment is formed of aluminum.

Figure 5:
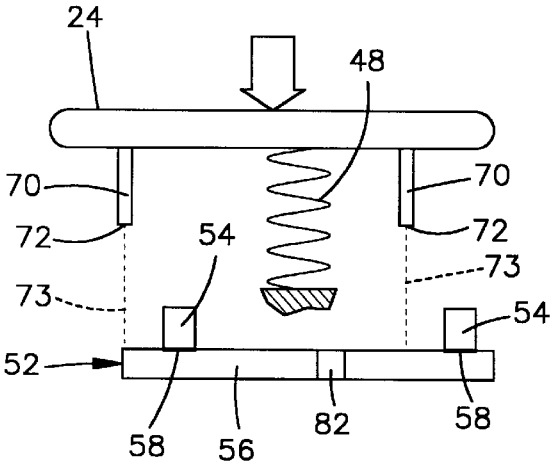
FIGS. 5–8 are top views of parts shown in FIGS. 2–4.
Figure 6:
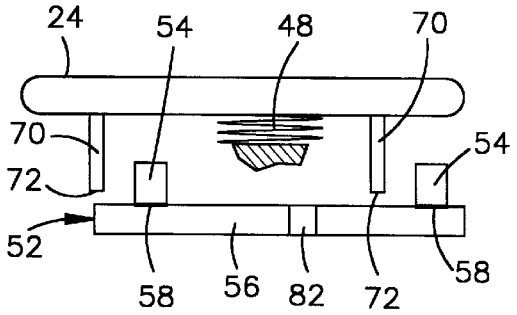

As further shown in FIGS. 2–4, the retarder device 52 is supported in the housing 20 by the guide structure 30 and the pushbutton 24. More specifically, the slider bar 56 adjoins the guide structure 30 near a top wall 60 of the housing 20, and extends across the upper edges 44 of the inner walls 42 of the pushbutton 24. The slider bar 56 is thus supported for longitudinal movement back and forth across the width of the buckle 12 in sliding contact with the guide structure 30 and the inner walls 42 of the pushbutton 24. In this manner, the retarder device 52 can be moved longitudinally relative to the pushbutton 24 back and forth between a non-actuated position, as shown in FIGS. 5 and 6, and an actuated position, as shown in FIGS. 7 and 8.

The inner walls 42 of the pushbutton 40 define a pair of actuator arms 70 that project inward from the outer wall 40 toward the retarder device 52. Each actuator arm 70 has an inner edge surface 72. When the pushbutton 24 is moved from the rest position of FIGS. 2 and 3 to the release position of FIG. 4, the actuator arms 70 move toward the retarder device 52. The actuator arms 70 then move along the paths indicated by the dashed lines 73 shown in FIG. 5. Accordingly, when the slider bar 56 is in the non-actuated position, the bumpers 54 are spaced from the paths of movement 73 of the actuator arms 70. The pushbutton 24 is then movable fully from the rest position (FIG. 5) to the release position (FIG. 6) without contacting the bumpers 54. Such movement of the pushbutton 24 is resisted substantially only by the springs 48 and 32 in the latch mechanism 26.

Figure 7:
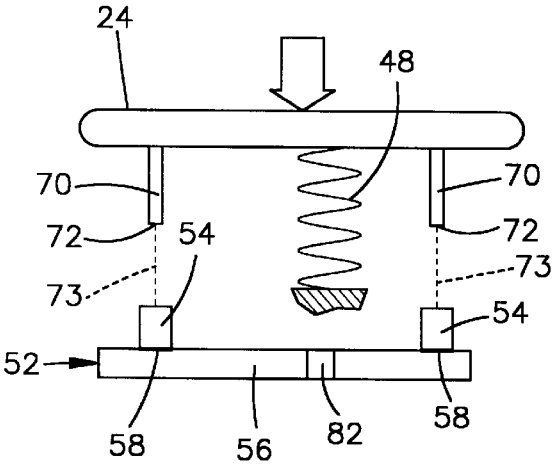
Figure 8:
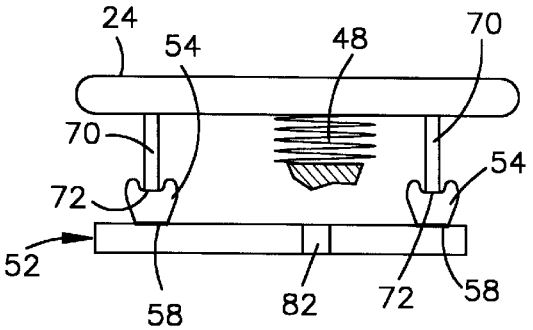

When the retarder device 52 is in the actuated position, as shown in FIG. 7, the bumpers 54 are located in the paths of movement 73 of the actuator arms 70. Therefore, the inner edge surfaces 72 of the actuator arms 70 move toward and into contact with the bumpers 54 before the pushbutton 24 reaches the release position. The actuator arms 70 must then be moved forcefully against the bumpers 54 so as to deflect the bumpers 54 compressively until the pushbutton 24 reaches the release position, as shown in FIG. 8. When the bumpers 54 are deflected in this manner, they provide reaction forces in addition to the bias of the springs 48 and 32 for resisting movement of the pushbutton 24 fully to the release position. The reaction forces provided by deflection of the bumpers 54 are great enough to prevent a small child from moving the pushbutton 24 fully to the release position.

The safety apparatus 50 further includes a switch 80 for shifting the retarder device 52 between the actuated and non-actuated positions. In the preferred embodiment of the present invention, the switch 80 is defined in part by the top wall 60 of the housing 20, and in part by a slider tab 82 projecting from the slider bar 56 into engagement with the top wall 60.

Figure 9:
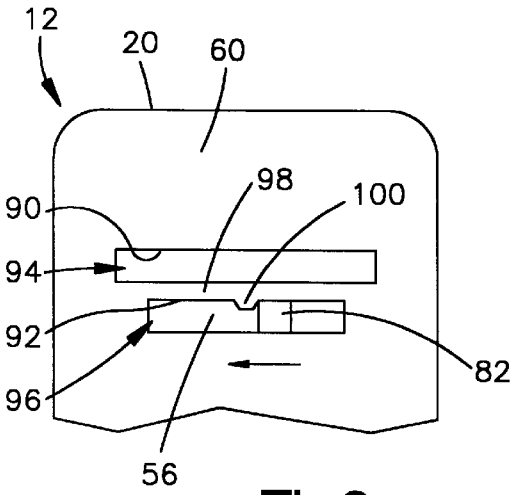
FIG. 9 is a view taken on line 9—9 of FIG. 2.
Figure 10:
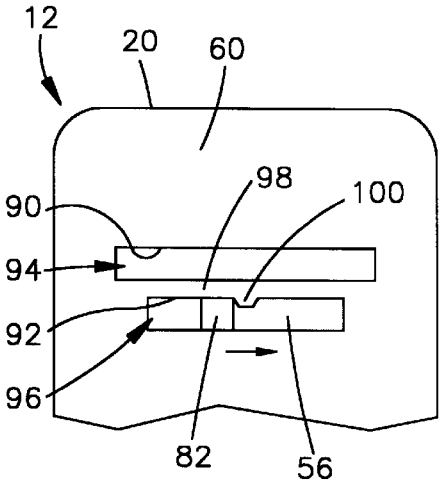
FIG. 10 is a view similar to FIG. 9 showing parts in different positions.

As best shown in FIGS. 9 and 10, the top wall 60 of the housing 20 has first and second inner edge surfaces 90 and 92 defining first and second slots 94 and 96, respectively. The slots 94 and 96 are closely spaced apart so as to define a narrow, strip-shaped section 98 of the top wall 60 that extends partially across the housing 20 between the slots 94 and 96. The slider tab 82 projects through the second slot 96.

A central section 100 of the strip 98 is shaped as a detent tab for the slider tab 82. The strip 98 is narrow enough to deflect as a detent spring upon movement of the slider tab 82 against and past the detent tab 100 in the direction of either of the arrows shown in FIGS. 9 and 10. Accordingly, the switch 80 comprises a detent mechanism that retains the retarder device 52 releasably in the non-actuated position (FIG. 9) or the actuated position (FIG. 10). Preferably, the strip 98 is stiff enough to require the use of a key, a coin, or a similar tool that an adult can use to push the slider tab 82 back and forth between the positions of FIGS. 9 and 10.

From the above description of the invention, those skilled in the art will perceive improvements, changes and modifications. For example, metal coil springs, leaf springs, or other spring devices could be used as alternatives for the elastomeric bumpers 54 in the preferred embodiment. Such springs could be portions of a one-piece metal retarder device that further has a slider portion as an alternative to the slider bar 56. Also, the rest position of the pushbutton 24 in the preferred embodiment is spaced from the actuated position of the retarder device 52, as shown in FIG. 7. However, such spacing is not essential. Such improvements, changes and modifications within the skill of the art are intended to be covered by the appended claims.

Having described the invention, the following is claimed:

1. Apparatus comprising:

a latch mechanism that releasably interlocks with a seat belt tongue, said latch mechanism including a pushbutton which is movable manually from a rest position to a release position to cause said latch mechanism to release the seat belt tongue from interlocked engagement with said latch mechanism; and a safety apparatus comprising a retarder device that is switchable into and out of an actuated condition in which said retarder device resists movement of said pushbutton during movement of said pushbutton to said release position.

2. Apparatus as defined in claim 1 further comprising a switch that is operable to switch said retarder device into and out of said actuated condition.

3. Apparatus as defined in claim 1 wherein said retarder device is located in an actuated position when in said actuated condition, said retarder device alternatively being located in a non-actuated position when out of said actuated condition.

4. Apparatus as defined in claim 3 wherein said retarder device is located in the path of movement of said pushbutton when in said actuated position, said retarder device being spaced from said path of movement when out of said actuated position.

5. Apparatus as defined in claim 3 wherein said rest position of said pushbutton is spaced from said actuated position of said retarder device.

6. Apparatus as defined in claim 3 wherein said safety apparatus further comprises a switch that is operable to shift said retarder device into and out of said actuated position.

7. Apparatus as defined in claim 6 wherein said switch comprises a detent mechanism which retains said retarder device releasably in or out of said actuated position.

8. Apparatus comprising:

a latch mechanism which releasably interlocks with a seat belt tongue, said latch mechanism including a pushbutton which is movable manually from a rest position to a release position to cause said latch mechanism to release the seat belt tongue from interlocked engagement with said latch mechanism; and a safety apparatus comprising a retarder device that is switchable into and out of an actuated position in which said retarder device is resiliently deflectable under stress induced by said pushbutton during movement of said pushbutton to said release position, whereby deflection of said retarder device provides a reaction force resisting said movement of said pushbutton to said release position;

said safety apparatus further including a switch that is operable to shift said retarder device into and out of said actuated position.

9. Apparatus as defined in claim 8 wherein said rest position of said pushbutton is spaced from said actuated position of said retarder device, whereby said pushbutton is initially movable from said rest position toward said retarder device free of said reaction force and is further movable to said release position against said reaction force.

10. Apparatus as defined in claim 8 wherein said switch comprises a detent mechanism which retains said retarder device releasably in or out of said actuated position.

11. Apparatus as defined in claim 10 further comprising a seat belt buckle housing containing said retarder device, said detent mechanism comprising a detent spring defined by a resiliently deflectable portion of said housing.

12. Apparatus comprising:

a latch mechanism that releasably interlocks with a seat belt tongue, said latch mechanism including a pushbutton which is movable manually from a rest position to a release position to cause said latch mechanism to release the seat belt tongue from interlocked engagement with said latch mechanism; and a safety apparatus comprising a retarder device that is switchable into and out of an actuated condition in which said retarder device resists movement of said pushbutton during movement of said pushbutton to said release position;

said retarder device, when in said actuated condition, being resiliently deflectable under stress induced by said pushbutton upon said movement of said pushbutton to said release position, whereby deflection of said retarder device provides a reaction force resisting said movement of said pushbutton to said release position.

13. Apparatus as defined in claim 12 wherein said retarder device is resiliently deflectable compressively under said stress.

14. Apparatus as defined in claim 13 wherein said retarder device comprises an elastomeric bumper.

* * * * *